US007641023B2

(12) United States Patent
Hintze

(10) Patent No.: US 7,641,023 B2
(45) Date of Patent: Jan. 5, 2010

(54) MECHANISM GENERATING AT LEAST ONE TYPE OF SONORITY

(75) Inventor: Hans-George Hintze, Dippoldiswalde/OT Paulsdorf (DE)

(73) Assignee: Glashütter Uhrenbetrieb GmbH, Glashütte/Sachsen (DE)

( * ) Notice: Subject to any disclaimer, the term of this patent is extended or adjusted under 35 U.S.C. 154(b) by 242 days.

(21) Appl. No.: 11/912,265

(22) PCT Filed: Apr. 3, 2006

(86) PCT No.: PCT/EP2006/003011

§ 371 (c)(1),
(2), (4) Date: Oct. 22, 2007

(87) PCT Pub. No.: WO2006/111262

PCT Pub. Date: Oct. 26, 2006

(65) Prior Publication Data

US 2008/0185214 A1 Aug. 7, 2008

(30) Foreign Application Priority Data

Apr. 22, 2005 (EP) ..... 05008838

(51) Int. Cl.
*G10K 11/18* (2006.01)

(52) U.S. Cl. ..... 181/142; 84/94.1; 84/94.2; 84/98

(58) Field of Classification Search ..... 181/142; 84/94.1, 94.2, 95.1, 95.2, 97, 98
See application file for complete search history.

(56) References Cited

U.S. PATENT DOCUMENTS

| | | | | |
|---|---|---|---|---|
| 527,811 | A * | 10/1894 | Richter | 84/98 |
| 560,936 | A * | 5/1896 | Rodeck | 84/98 |
| 4,466,328 | A * | 8/1984 | Kitamura | 84/98 |
| 5,521,321 | A * | 5/1996 | Liu | 84/95.1 |
| 5,962,796 | A * | 10/1999 | Nakamura et al. | 84/97 |
| 2003/0150316 | A1 | 8/2003 | Muramatsu | |
| 2003/0230188 | A1 | 12/2003 | Kaneko et al. | |

FOREIGN PATENT DOCUMENTS

| | | |
|---|---|---|
| DE | 129682 | 4/1902 |
| FR | 2777095 | 10/1999 |

OTHER PUBLICATIONS

International Search Report issued in corresponding application No. PCT/EP2006/003011, completed Jul. 12, 2006 and mailed Jul. 19, 2006.

* cited by examiner

*Primary Examiner*—Jeffrey Donels
*Assistant Examiner*—Jeremy Luks
(74) *Attorney, Agent, or Firm*—Griffin & Szipl, P.C.

(57) ABSTRACT

The invention concerns a sound generator mechanism including a control member (10) and a mechanism (14) for locking/unlocking the control member (10), the control member (10) being able to move between a first position in which the control member is held by the locking/unlocking member (14) and in which it holds the vibrating member (12) away from the rest position thereof, and a second position wherein the control member is released by the locking/unlocking mechanism (14) and wherein it simultaneously releases the vibrating member (12), which starts to vibrate and to produce a sound.

24 Claims, 2 Drawing Sheets

MECHANISM GENERATING AT LEAST ONE TYPE OF SONORITY

This is a National Phase Application in the United States of International Patent Application No. PCT/EP2006/003011 filed Apr. 3, 2006, which claims priority on European Patent Application No. 05008838.4, filed Apr. 22, 2005. The entire disclosures of the above patent applications are hereby incorporated by reference.

FIELD OF THE INVENTION

The present invention concerns a mechanism able to produce at least one sound, to be fitted, for example, to a timepiece such as a wristwatch.

BACKGROUND OF THE INVENTION

A strike mechanism commonly used in wristwatches includes a hammer which strikes a gong. The hammer is moved away from its rest position, then released and strikes the base portion of the gong which is arranged in a circle around the movement. One drawback of this type of strike mechanism is that the intensity of the sound produced is weak.

A second type of strike mechanism is similar to the strike mechanisms used in music boxes. A mechanism of this type is shown schematically in FIG. 1 annexed to this patent application. This mechanism, designated as a whole by the general reference numeral 1, essentially includes a rotating drum 2 at the surface of which are arranged lugs 4. When drum 2 rotates, one of the lugs 4 lifts up a gong 6 and gradually moves it away from its rest position until gong 6 is released from lug 4 and abruptly relaxes. While relaxing, gong 6 vibrates and produces a sound. This mechanism has the advantage of producing sounds of greater intensity. However, driving rotating drum 2 requires a significant amount of energy, which makes it difficult to integrate this mechanism in a watch which has only a small energy reserve.

It is an object of the present invention to overcome the aforementioned drawbacks in addition to others by providing a sound generating mechanism that can easily be integrated for example in a wristwatch and that produces a sound of great intensity.

SUMMARY OF THE INVENTION

The present invention therefore concerns a sound generator mechanism including a control member, a vibrating member and a mechanism for locking/unlocking the control member, the control member being able to move between a first position in which it is retained by the locking/unlocking mechanism and a second position in which it is released by the locking/unlocking mechanism and in which it simultaneously releases the vibrating member, which starts to vibrate and to produce a sound.

Owing to these features, the present invention provides a sound generator mechanism, which, by moving the vibrating member away from its rest position then abruptly releasing it, is capable of producing a sound of great intensity.

According to a complementary feature of the invention, the sound generator mechanism is wound by an action of the user and is released when a time process reaches an end.

According to another feature of the invention, the control member moves by pivoting between its first and second positions.

According to yet another feature of the invention, the control member includes a cam and the locking/unlocking mechanism includes a spring with a catch.

To release the cam and generate a sound, it is only sufficient to act on a spring element, which necessitates little energy and makes the sound generator mechanism of the invention particularly easy to integrate into a wristwatch for example.

BRIEF DESCRIPTION OF THE DRAWINGS

Other features and advantages of the present invention will appear more clearly from the following detailed description of one embodiment of the sound generator mechanism according to the invention, this example being given purely by way of non-limiting illustration, in conjunction with the annexed drawing, in which.

DETAILED DESCRIPTION OF THE INVENTION

The present invention proceeds from the general inventive idea which consists in providing a sound generator mechanism able to produce sounds of high intensity while requiring little energy to be switched on, which makes this object particularly easy to integrate in a portable object such as, for example, a wristwatch. Thus, the sound generator mechanism according to the invention includes a control member, which, in a first locked position, moves a vibrating member away from its rest position and which, in a second unlocked position, releases the vibrating member which starts to vibrate and to produce a sound of high intensity.

Figure 1:
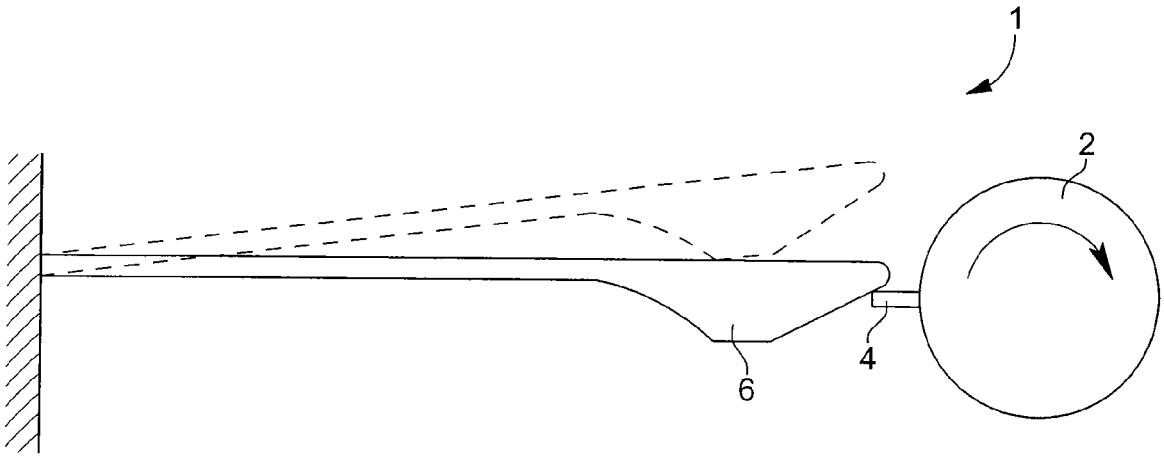
Fig. 1 ( Prior Art )
FIG. 1, already cited, is a schematic diagram of a strike mechanism of the prior art.
Figure 2A:
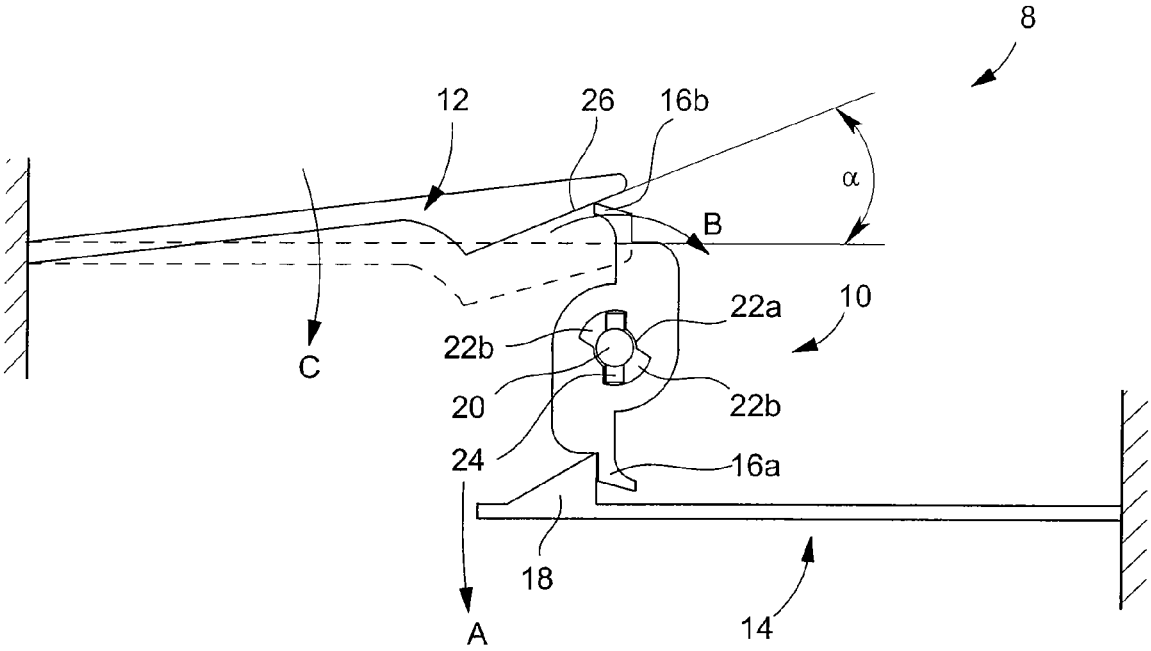
FIG. 2*a* is a schematic cross-section of the sound generator mechanism in accordance with the present invention in a locked position.

Designated as a whole by the general reference numeral 8, the sound generator mechanism according to the invention shown in cross-section in FIG. 2*a* essentially includes a control member 10, a vibrating member 12 and a locking/unlocking mechanism 14. More specifically, the control member 10 takes the form of a cam fitted with two diametrically opposite lugs 16*a* and 16*b*. Locking/unlocking mechanism 14 takes the form of a strip spring secured at one of the ends thereof and having a catch 18 at the free end thereof. Finally, the vibrating member 12 is formed by a strip-shaped gong.

As can be seen upon examining the Figures, cam 10 is pivotably mounted on a drive arbour 20. Thus, cam 10 has an aperture 22 formed of a central cylindrical passage 22*a* via which the cam 10 is mounted on drive arbour 20 and two cut portions in the shape of an arc of a circle 22*b* which open into central passage 22*a*. Cam 10 is coupled with drive arbour 20 via a retaining member 24 such as a key secured to drive arbour 20 and the role of which is described hereinafter.

In the position shown in FIG. 2*a*, cam 10 is locked, one of the lugs 16*a* abutting against catch 10 of strip spring 14, whereas via the other end 16*b* thereof, cam 10 holds gong 12 away from its horizontal rest position shown in dot and dash lines for example along an angle $\alpha$ of approximately 18°. At the end of a time process such as counting the time before the current time coincides with an alarm time, a motor mechanism (not shown) which may be driven by the watch movement moves spring 14 away downwards along arrow A. As cam 10 is no longer locked, it is free to pivot in the clockwise direction along arrow B via the effect of the bending force exerted by going 12 which is trying to return to its horizontal rest position by moving along arrow C. In order to facilitate the relative movement of cam 10 and gong 12, gong 12 advantageously has at the free end thereof an over thickness in which an inclined plane 26 is arranged, along which lug 16*b* can slide.

Released from the hold of cam 10, gong 12 can return to its horizontal rest position by vibrating and transmitting an acoustic signal of high intensity. As will have been understood, the only energy necessary for starting the sound generator mechanism according to the invention is that which has to be provided to move spring 14 away from the position in which it locks cam 10. The quantity of energy to be provided is thus very low, which means that it is easy to envisage integrating the mechanism according to the invention for example in a watch, which, as is known, can only store a very limited quantity of energy.

Figure 2B:
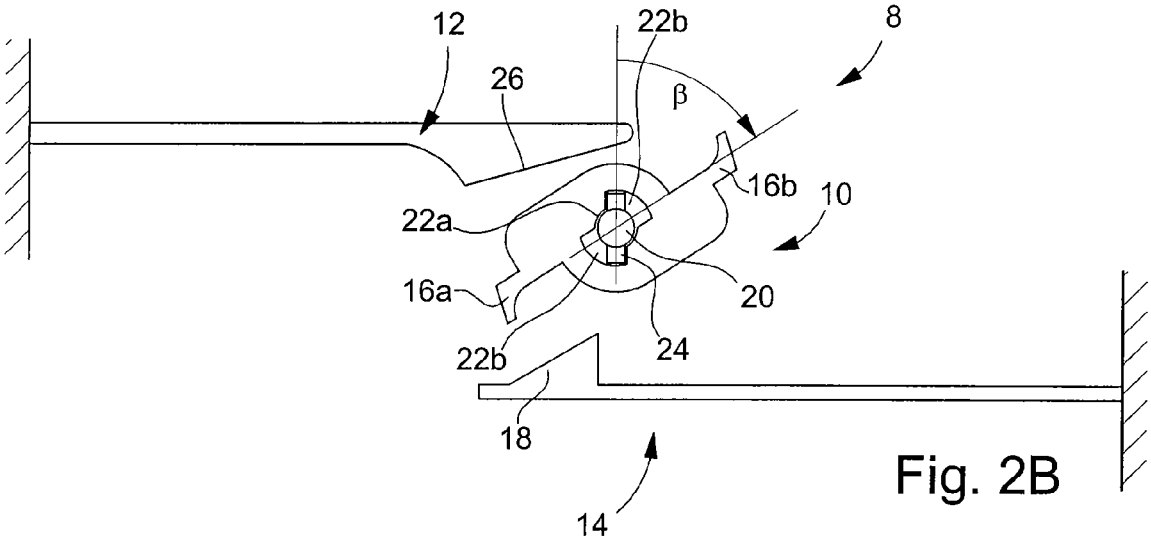
FIG. 2*b* is a similar view to that of FIG. 2*a* showing the sound generator mechanism in the unlocked position thereof.

As was seen above, when the spring with a catch 14 releases cam 10, the latter pivots in the clockwise direction along arrow B. Cam 10 is however limited in its pivoting movement by retaining member 24 which is secured to drive arbour 20 and which will abut against the bottom of the portions cut out having the shape of an arc of a circle 22*b* formed in aperture 22 (see FIG. 2*b*). The pivoting angle β of the cam is approximately 35°.

The sound generator mechanism according to the invention is rewound by the user who can, for example, exert pressure on a button, via the effect of which drive arbour 20 makes a 180° movement. As cam 10 has pivoted by approximately 35° and abutted, via the edges of its portions cut out having the shape of an arc of a circle 22*b*, against retaining element 24, drive arbour 20 will only start to drive cam 10 when the retaining element abuts against the opposite edges of the portions cut out in the arc of a circle 22*b* arranged in aperture 22. While drive arbour 20 completes a rotation of 180°, cam 10 will only move by 180−35=135° to return to its initial position illustrated in FIG. 2*a*.

It will be noted that the present invention is not limited to the embodiment that has just been described and those skilled in the art could envisage various simple alterations and variations without departing from the scope of the present invention as defined by the annexed claims. In particular, the sound generator mechanism according to the invention could be wound by means of a motor. One could also envisage arranging several mechanisms in accordance with the invention, but with different sound frequencies produced by the respective gongs, in parallel in order to generate a melody.

The invention claimed is:

1. A sound generator mechanism including:

a control member;

a vibrating member;

and a mechanism for locking/unlocking the control member, wherein the control member is able to move between a first position in which the control member is held by the locking/unlocking mechanism and in which the control member holds the vibrating member in a bent position away from a rest position thereof, and a second position wherein the control member is released by the locking/unlocking mechanism and wherein the control member is pushed back via bending force effect by the vibrating member that returns to the rest position while starting to vibrate and to produce a sound.

2. The sound generator mechanism according to claim 1, wherein said locking/unlocking mechanism is wound by an action of the user and started when a time process reaches an end.

3. The sound generator mechanism according to claim 1, wherein the control member moves by pivoting between the first and second positions thereof.

4. The sound generator mechanism according to claim 2, wherein the control member moves by pivoting between the first and second positions thereof.

5. The sound generator mechanism according to claim 1, wherein the control member includes a cam, the locking/unlocking mechanism includes a spring, and the vibrating member includes a gong.

6. The sound generator mechanism according to claim 2, wherein the control member includes a cam, the locking/unlocking mechanism includes a spring, and the vibrating member includes a gong.

7. The sound generator mechanism according to claim 3, wherein the control member includes a cam, the locking/unlocking mechanism includes a spring, and the vibrating member includes a gong.

8. The sound generator mechanism according to claim 4, wherein the control member includes a cam, the locking/unlocking mechanism includes a spring, and the vibrating member includes a gong.

9. The sound generator mechanism according to claim 5, wherein the cam is driven by a drive arbour with which said cam is coupled via a retaining member secured to the drive arbour.

10. The sound generator mechanism according to claim 6, wherein the cam is driven by a drive arbour with which said cam is coupled via a retaining member secured to the drive arbour.

11. The sound generator mechanism according to claim 7, wherein the cam is driven by a drive arbour with which said cam is coupled via a retaining member secured to the drive arbour.

12. The sound generator mechanism according to claim 8, wherein the cam is driven by a drive arbour with which said cam is coupled via a retaining member secured to the drive arbour.

13. The sound generator mechanism according to claim 9, wherein the cam has an aperture formed of a cylindrical central passage via which said cam is mounted on the drive arbour and two diametrically opposite portions cut out in the shape of an arc of a circle and both diametrically opposite portions open into the central passage.

14. The sound generator mechanism according to claim 10, wherein the cam has an aperture formed of a cylindrical central passage via which said cam is mounted on the drive arbour and two diametrically opposite portions cut out in the shape of an arc of a circle and both diametrically opposite portions open into the central passage.

15. The sound generator mechanism according to claim 11, wherein the cam has an aperture formed of a cylindrical central passage via which said cam is mounted on the drive arbour and two diametrically opposite portions cut out in the shape of an arc of a circle and both diametrically opposite portions open into the central passage.

16. The sound generator mechanism according to claim 12, wherein the cam has an aperture formed of a cylindrical central passage via which said cam is mounted on the drive arbour and two diametrically opposite portions cut out in the shape of an arc of a circle and both diametrically opposite portions open into the central passage.

17. The sound generator mechanism according to claim 13, wherein the retaining member projects into the portions cut out in the shape of an arc of a circle made in the aperture of the cam that limits play of said cam around the drive arbour.

18. The sound generator mechanism according to claim 14, wherein the retaining member projects into the portions cut out in the shape of an arc of a circle made in the aperture of the cam that limits play of said cam around the drive arbour.

19. The sound generator mechanism according to claim 15, wherein the retaining member projects into the portions cut out in the shape of an arc of a circle made in the aperture of the cam that limits play of said cam around the drive arbour.

20. The sound generator mechanism according to claim 16, wherein the retaining member projects into the portions cut out in the shape of an arc of a circle made in the aperture of the cam that limits play of said cam around the drive arbour.

21. The sound generator mechanism according to claim 13, wherein the portions cut out in the arc of a circle each form an angular sector substantially equal to 35°.

22. The sound generator mechanism according to claim 17, wherein the portions cut out in the arc of a circle each form an angular sector substantially equal to 35°.

23. The sound generator mechanism according to claim 1, wherein the cam includes two lugs via which they respectively cooperate with a catch arranged at a free end of the spring for temporary immobilisation thereof, and with the gong to temporarily move the latter away from the rest position thereof.

24. The sound generator mechanism according to claim 5, wherein the gong includes an inclined plane at a free end thereof.

* * * * *